US008602167B2

(12) United States Patent
Aamand et al.

(10) Patent No.: US 8,602,167 B2
(45) **Date of Patent: *Dec. 10, 2013**

(54) LUBRICATING APPARATUS AND METHOD FOR DOSING CYLINDER LUBRICATION OIL

(75) Inventors: Jan Aamand, Vojens (DK); Peer Bak, Saeby (DK)

(73) Assignee: Hans Jensen Lubricators A/S, Hadsund (DK)

( * ) Notice: Subject to any disclaimer, the term of this patent is extended or adjusted under 35 U.S.C. 154(b) by 247 days.

This patent is subject to a terminal disclaimer.

(21) Appl. No.: 12/451,557

(22) PCT Filed: May 16, 2008

(86) PCT No.: PCT/DK2008/050111

§ 371 (c)(1),
(2), (4) Date: Feb. 4, 2010

(87) PCT Pub. No.: WO2008/141650

PCT Pub. Date: Nov. 27, 2008

(65) Prior Publication Data

US 2010/0162989 A1 Jul. 1, 2010

(30) Foreign Application Priority Data

May 18, 2007 (DK) ..... 2007 00744

(51) Int. Cl.
*F01M 1/00* (2006.01)

(52) U.S. Cl.
USPC ..... 184/6.8; 123/73 AD; 123/90.33; 123/190.13; 123/196 R; 123/196 CP; 184/6.5; 184/55.1; 440/88 L

(58) Field of Classification Search
USPC ..... 123/495, 446, 467, 506, 450, 500, 486, 123/357, 73 AD, 90.33, 190.13, 196 V, 123/196 R; 417/269, 273, 212, 53, 289, 417/364; 184/26, 32, 6.5, 6.6, 6.8, 6.9, 7.3, 184/34, 55.1; 74/569; 440/88 L
See application file for complete search history.

(56) References Cited

U.S. PATENT DOCUMENTS

| | | | | |
|---|---|---|---|---|
| 6,227,167 | B1 * | 5/2001 | Smith et al. | 123/446 |
| 6,543,424 | B1 * | 4/2003 | Yamaguchi et al. | 123/495 |
| 6,928,975 | B2 | 8/2005 | Lauritsen | |

(Continued)

FOREIGN PATENT DOCUMENTS

| | | |
|---|---|---|
| CH | 673506 | 3/1990 |

(Continued)

*Primary Examiner* — Lindsay Low
*Assistant Examiner* — Kevin Lathers
(74) *Attorney, Agent, or Firm* — James Creighton Wray

(57) ABSTRACT

There is described a hydraulic lubricating apparatus (252) for dosing cylinder lubricating oil, including a housing which via one or more valves (220) is connected to a source for supplying hydraulic oil (262) and cylinder lubricating oil (not shown), a number of hydraulic cylinders each having a hydraulic piston (6) and which may be pressurized by hydraulic oil. Furthermore, there are a number of injection units (251) corresponding to a multiple of the cylinder (250) number in the engine, and which are connected with each their dosing cylinder by a dosing piston (21). Also, there is provided a distributor plate (7) which at one side is in contact with the dosing pistons (21) and which at its other side is in contact with the hydraulic pistons (6) for displacing the distributor plate for actuating the dosing pistons. The hydraulic pistons (6) are provided in groups, where each group is adapted for independent displacement of the distributor plate (7) for actuating the dosing pistons, and where each group of hydraulic pistons have each their individual stroke. In that way there may be achieved an individual quantity adjustment of lubricating oil, depending on the group of hydraulic pistons that is activated.

12 Claims, 8 Drawing Sheets

(56) References Cited

U.S. PATENT DOCUMENTS

| | | | | |
|---|---|---|---|---|
| 8,210,317 | B2 * | 7/2012 | Aamand | 184/6.8 |
| 2005/0276701 | A1 * | 12/2005 | Bowers et al. | 417/269 |
| 2010/0006056 | A1 | 1/2010 | Aamand | |

FOREIGN PATENT DOCUMENTS

| | | | | |
|---|---|---|---|---|
| DE | 2827626 | | 10/1979 | |
| DK | 9901836 | * | 12/1999 | F01M 1/16 |
| DK | 173288 | B1 | 6/2000 | |
| GB | 834533 | | 5/1960 | |
| JP | 2004-239157 | A | 8/1992 | |
| JP | 2004239157 | A * | 8/2004 | F01M 1/16 |
| WO | 2007/057027 | | 5/2007 | |
| WO | 2008/009291 | | 1/2008 | |
| WO | WO 2008009291 | A1 * | 1/2008 | F16N 25/00 |

* cited by examiner

LUBRICATING APPARATUS AND METHOD FOR DOSING CYLINDER LUBRICATION OIL

This application claims the benefit of Danish Application No. PA 2007 00744 filed May 18, 2007 and PCT/DK2008/050111 filed May 16, 2008, which are hereby incorporated by reference in their entirety.

FIELD OF THE INVENTION

The present invention concerns a hydraulic lubricating apparatus for dosing cylinder lubricating oil, e.g. in marine engines as disclosed in U.S. Pat. No. 8,210,317, the lubricating apparatus including

- a housing which via one or more valves is connected with a source for supplying hydraulic oil and cylinder lubricating oil;
- a number of hydraulic cylinders that each have a hydraulic piston and which may be pressurised by hydraulic oil;
- a number of injection units corresponding to a multiple of the cylinder number in the engine, and which are connected with each their dosing cylinder with a dosing piston;
- a distributor plate which at one side of it is in contact with the dosing pistons and which at its other side is in contact with the hydraulic pistons for displacing the distributor plate for actuating the dosing pistons.

Moreover, the invention concerns a method for a dosing cylinder lubricating oil, e.g. in marine engines, the method including:

- a supply of hydraulic oil via a number of hydraulic cylinders that each have a hydraulic piston and which is pressurised by the hydraulic oil;
- supplying and injecting cylinder lubricating oil via a number of injection units corresponding to a multiple of the cylinder number in the engine, which injection units being connected with each their dosing cylinder with a dosing piston;
- a distributor plate is brought in contact with the dosing pistons at one side and which at its other side is brought in contact with the hydraulic pistons for displacing the distributor plate for actuating the dosing pistons.

BACKGROUND OF THE INVENTION

Lubricating apparatuses are traditionally designed as pumping units which are mounted in close association with respective cylinders and which are connected with a feeding reservoir for lubricating oil and with lubricating points in the form of oil injection nozzles at different points on the cylinder wall. Each pump unit includes a plurality of reciprocating pumps that feed various lubricating points with oil and which are driven by a common rotating control shaft with cams provided thereon. By the rotation of the shaft, the cams with pressing heads act on respective axially displacing pistons which are spring biased in direction towards the control shaft, so that the pistons at the rotation of the shaft will perform reciprocating movements for activating the pistons of the reciprocating pumps.

It has also been proposed to adjust the pump stroke by means of a controllable motor, e.g. a step motor. This has been used for point lubrication, but it is difficult to establish in connection with conventional lubricating apparatuses. Such a system is e.g. disclosed in International patent application WO 02/35068 A1.

Furthermore, from DE 28 27 626 there is known a lubricating system based on lubricating oil supplied in measured quantities for predetermined time intervals through openings in the cylinder wall. Here, there is not indicated any possibility of a stepless controlling of the dosing to be performed at the individual lubricating points.

Furthermore, from GB 834533 A, DK 173512 B1 or CH 673506 A5 systems of the type mentioned in the introduction are known, where a hydraulic cylinder via a distributor plate or similar structure acts on a plurality of dosing pistons. In these designs, there will be one hydraulic cylinder for the activation. Here there is a need for separate adjusting means for quantity adjustment of the cylinder lubricating oil.

The present invention may be applied in connection with all kinds of lubricating apparatuses and methods based on hydraulic lubrication using hydraulic pistons and used for acting on injection units that include dosing pistons for the cylinder lubricating oil.

OBJECT OF THE INVENTION

It is the object of the invention to indicate a lubricating apparatus and a method for dosing cylinder lubricating oil, wherein a quantity adjustment of the cylinder lubricating oil may be established in a simple way.

DESCRIPTION OF THE INVENTION

According to the present invention, this is achieved by a lubricating apparatus of the type specified in the introduction, which is peculiar in that the hydraulic pistons are provided in groups, that each group is adapted for independent displacement of the distributor plate for actuating the dosing pistons, and that each group of hydraulic pistons have each their individual stroke.

The method according to the invention is peculiar in that the hydraulic pistons are provided in groups, that each group independently displace the distributor plate for actuating the dosing pistons, and that each group of hydraulic pistons have each their individual stroke.

According to an advantageous embodiment, the method is peculiar in that only one hydraulic piston is used for each group.

In that way there may be achieved an individual quantity adjustment of lubricating oil, depending on the group of hydraulic pistons that is activated.

A distributor plate is used for driving one or more dosing pistons. The distributor plate is activated hydraulically by a hydraulic system supplying a system pressure. The apparatus operates in that there are a plurality of groups of hydraulic pistons, where each group may be activated independently of the others. Therefore, only one or some of the groups of hydraulic cylinders contained in the lubricating apparatus may be used in certain cases.

According to yet an embodiment, the lubricating apparatus according to the invention is peculiar in that the hydraulic pistons are provided in groups, that each group is arranged for displacing the distributor plate for activating the dosing pistons, and that each group of hydraulic pistons each have their individual stroke so that individual quantity adjustment of lubricating oil is achieved, depending on the group of hydraulic pistons that are activated.

This may be effected in that each group of hydraulic pistons operates with its own stroke so that when a first group of pistons is activated, a first stroke length occurs, and when a second group is activated, a second stroke length occurs. The amount of lubricating oil may thus be regulated by making an algorithm. The algorithm may be adapted such that by combining the use of two or more stroke lengths, an approximately stepless quantitative adjustment is attained within the range of strokes.

This principle is thus based on the fact that two or more types of hydraulic pistons are used, where a first group of hydraulic pistons can be extended up through the distributor plate, thereby preventing the distributor plate from moving to an extreme position. When a second piston group is activated, the distributor plate may be moved to the extreme position and be stopped by the base block.

It is noted that each group of hydraulic pistons is only required to comprise one hydraulic piston. Hereby is achieved a simple and compact design. This design can be particularly simple and compact if the hydraulic pistons are provided telescoping with several pistons disposed within each other.

The telescoping hydraulic pistons may preferably be cylindric and disposed coaxially, as hereby there is achieved a particularly simple design enabling quantity adjustment of the cylinder lubricating oil by arbitrary extension of the telescoping piston unit for desired discharge of cylinder lubricating oil. This may be controlled by an algorithm in an electronic control unit/computer.

According to a further embodiment, in each group of hydraulic pistons there may be two or more pistons. Hereby it is ensured that displacement of the distributor plate is effected, even if a piston in a group fails. Also in this embodiment, the hydraulic pistons may be provided telescoping with several pistons disposed within each other.

According to a further embodiment, holes are formed in the distributor plate, and that at least some of the hydraulic pistons extend through these holes. Moreover, it is possible to use a surface within the housing and above the distributor surface as contact surface for the hydraulic pistons. In a particularly simple way is hereby achieved an end stop for the displacement of the distributor plate and thereby for the quantity adjustment.

The lubricating apparatus has the following operational mode:

The lubricating apparatus has, as mentioned, two built-in solenoid valves. When a pumping cycle starts, solenoid valves are opened, and the system pressure (typically between 40 and 120 bar) is fed into the apparatus, pressurising the hydraulic chamber.

By applying pressure, the hydraulic piston is moved to the bottom, and together with this piston the dosing piston for lubricating oil is also forced to the bottom, and the lubricating oil in the space in front of the dosing piston is pressed out through a non-return valve with spring loading.

The solenoid valve then closes at the inlet side, and after a defined time the solenoid valve opens at the outlet side and the pressure is removed. Spring is pressing on the distributor plate, thereby pressing the hydraulic pistons to the original position, and at the same time new lubricating oil is sucked into the cylinder chamber of the dosing unit.

The amount of cylinder lubricating oil delivered by the dosing pistons is adjusted by using the hydraulic piston or pistons which ensure correct displacement of the distributor plate in order to provide the required displacement of the dosing pistons.

Each lubricating point may have a venting screw so that possible air in the cylinder chamber of the dosing unit can be removed hereby.

If any system or lubricating oil should leak past respective pistons, this leak oil is gathered and may be drained off in total from the lubricating apparatus.

The present invention may be applied in a dosing system of the type described in the DK patent application with the title "Lubricating apparatus for a dosing system for cylinder lubricating oil and method for dosing cylinder lubricating oil" which is filed simultaneously with the present patent application, the contents thereof hereby being incorporated by reference. Only the way in which the quantity adjustment is performed will be changed.

DESCRIPTION OF THE DRAWING

The invention will then be explained in more detail with reference to the accompanying drawing, where.

DETAILED DESCRIPTION OF THE INVENTION

Figure 1:
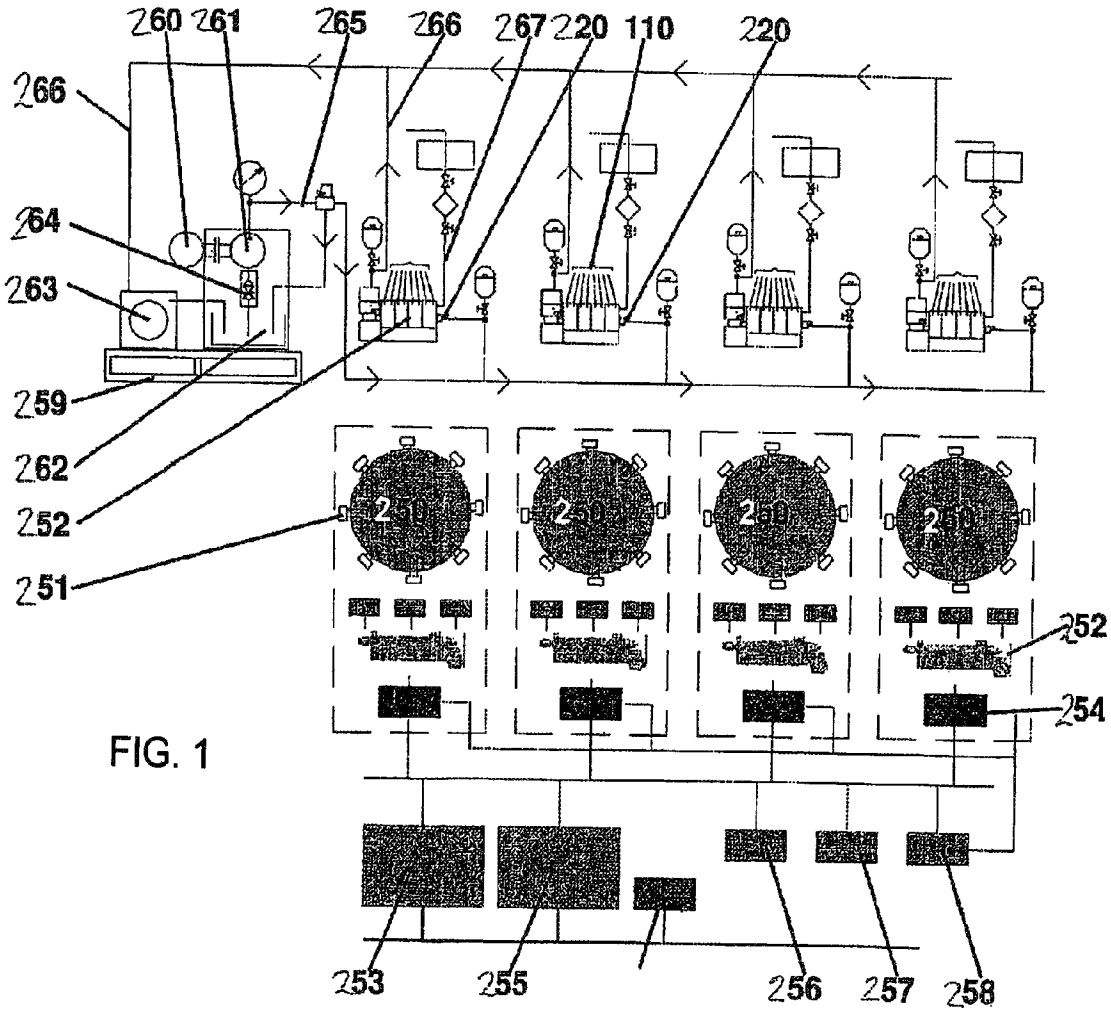
FIG. 1 shows a schematic overview of a system with a plurality of lubricating apparatuses according to the invention.

FIG. 1 shows schematically four cylinders 250 and on each cylinder appears eight injection nozzles 251. The lubricating apparatuses 252 according to the present invention are connected with a central computer 253 with local control units 254, typically for each single lubricating apparatus 252.

The central computer 253 is coupled in parallel with a further control unit 255 constituting a backup for the central computer. In addition, there is established a monitoring unit 256 monitoring the pump (can be a hydraulic pump or a hydraulic station), a monitoring unit 257 monitoring the load and a monitoring unit 258 monitoring the position of the crankshaft.

In the upper part of FIG. 1 there is shown a hydraulic station 259 comprising a motor 260 driving a pump 261 in a tank 262 for hydraulic oil. The hydraulic station 259 furthermore includes a cooler 263 and a filter 264. System oil is pumped via supply line 265 on to the lubricating apparatus via a valve 220. The hydraulic station is furthermore connected with a return line 266 which is also connected with the lubricating apparatus via a valve.

Lubricating oil is forwarded to lubricating apparatus 252 via a line 267 from a lubricating oil supply tank (not shown). The lubricating oil is forwarded from the lubricating apparatus via lines 110 to the injection nozzles 251.

Figure 2:
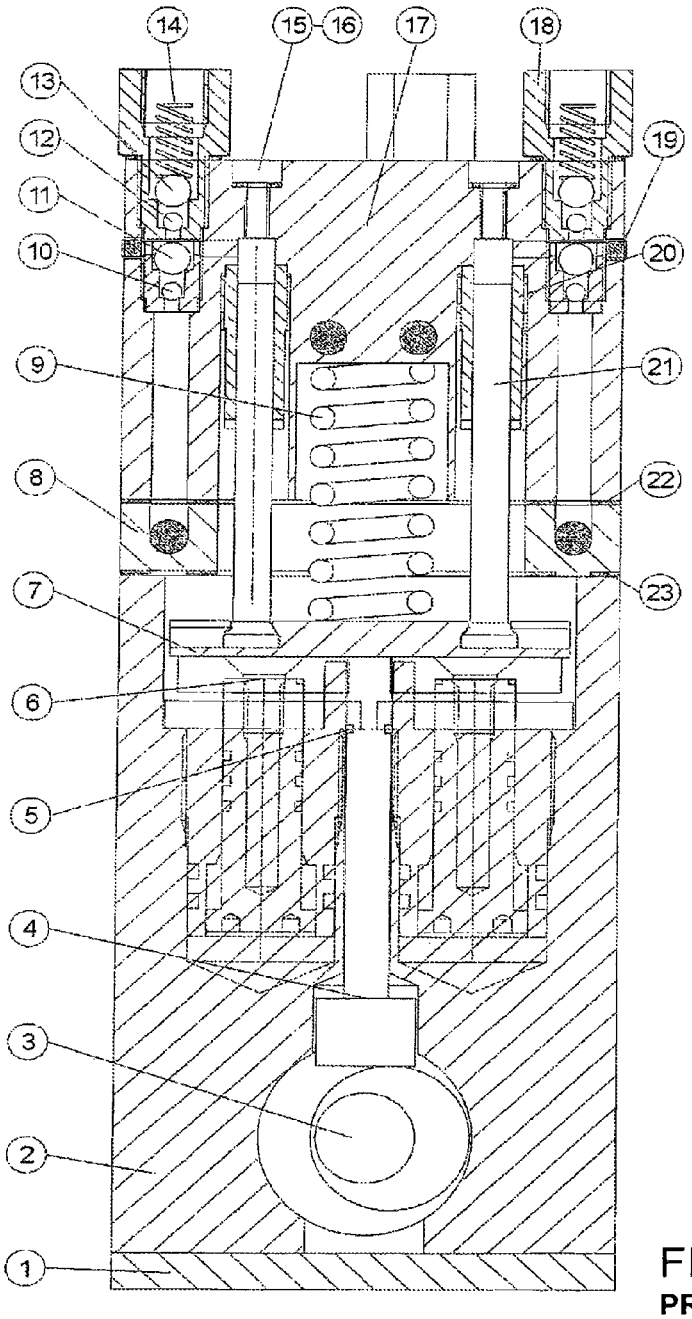
FIG. 2 PRIOR ART
FIG. 2 shows a sectional view through an embodiment of a prior art lubricating apparatus.

FIG. 2 shows a section through a known lubricating apparatus which can be modified for utilising advantages of the present invention.

Pos. 1 shows a bottom plate with a packing that enables mounting of set pin 4 which is fastened with a screw from below.

Pos. 2 shows a base block with a number of hydraulic pistons 6.

Pos. 3 shows an eccentric shaft whereby the stroke may be regulated by activating a DC motor 27. Alternatively, the stroke length may also be regulated by a spindle, see FIG. 8.

Pos. 4 shows a set pin which is used as an adjustable stop whereby the stroke can be regulated as displacement of set pin 4 may change the point at which the distributor plate 7 is stopped.

Pos. 5 shows a packing around set pin 4 ensuring that possible leaking oil does not run down into the eccentric housing. One may possibly omit the O-ring 5 in the shown design and instead move possible leak oil away from the cavity around the eccentric shaft 3.

Pos. 6 shows a hydraulic piston which at one side "pushes" the distributor plate 7 and at the other side is acted on by the hydraulic system oil pressure from the pressure supply ducts 61 and 62, respectively. Note that the said ducts are independent of each other. The shown design has two groups of hydraulic pistons, each of these groups in the shown design consisting of two hydraulic pistons, but it is also possible to have more than two hydraulic pistons in one group.

Pos. 7 shows the distributor plate which is pushed by the hydraulic pistons 6 at one side and which acts on the dosing pistons 21 at the other side. By blocking dosing or hydraulic pistons, the distributor plate 7 may capsize, and it is possible to design the distributor plate in such a way providing that capsizing will not be a problem—alternatively it may appear necessary to control the distributor plate 7 either directly or indirectly.

Pos. 8 shows an intermediate plate which is mainly used for conducting the lubricating oil to a pump block 17 and to enable a more flexible fastening of the pump block. Finally, the intermediate plate also ensures that, if desired, one may divide the pump block into sections without leakage taking place.

Pos. 9 shows a spring which in the shown construction is a return spring. There is only one common return spring in the shown construction, but in principle one may also envisage that every dosing piston has its own return spring.

Pos. 10-13 show double suction and pressure valves where the lubricating oil is fed to the pump chamber in front of the dosing piston 21. When the individual lubricating point goes from suction to pressure stroke, the suction valves 10 and 11 and pressure valves 11 and 12 are opened when the pressure in the pump chamber in front of the pistons 21 is sufficiently high to overcome the compression spring 14.

Pos. 14 shows a pressure spring ensuring that the feed pressure of the lubricating oil cannot seep/run directly through the apparatus without control of the precise amount. In some cases, it may be an advantage to use a stronger compression spring as the delivery time for the lubricating oil may be relatively much reduced thereby. Normally, the compression spring is designed according to the pressure level in the lubricating oil supply 267, but in cases where a faster lubricating stroke performance is desired, the non-return valve 13 may advantageously be designed so that a higher pressure is to be built up for opening, thereby forcing a quicker delivery of the lubricating oil.

Pos. 15-16 show venting screw with packing.

Pos. 17 shows a pump block that may consist of one or more lubricating points. Typically, the apparatus is made with six or more lubricating points. It is possible that sectioning of the pump block 17 can be necessary, as replacement of possible failing components will be easier.

Pos. 18 shows a housing for pressure valves 12 and 13 and compression spring 14, and at the same time connection to the supply pipes is enabled.

Pos. 19 shows a blind plug closing the working channel between the pump chamber and the suction and pressure valves.

Pos. 20 shows a pump cylinder in which pump piston 21 is mounted.

Pos. 21 shows a pump piston for the dosing piston.

Pos. 22 shows a packing between the pump block 17 and the intermediate plate 8.

Pos. 23 shows a packing between the intermediate plate 8 and the base block 2.

Figure 3:
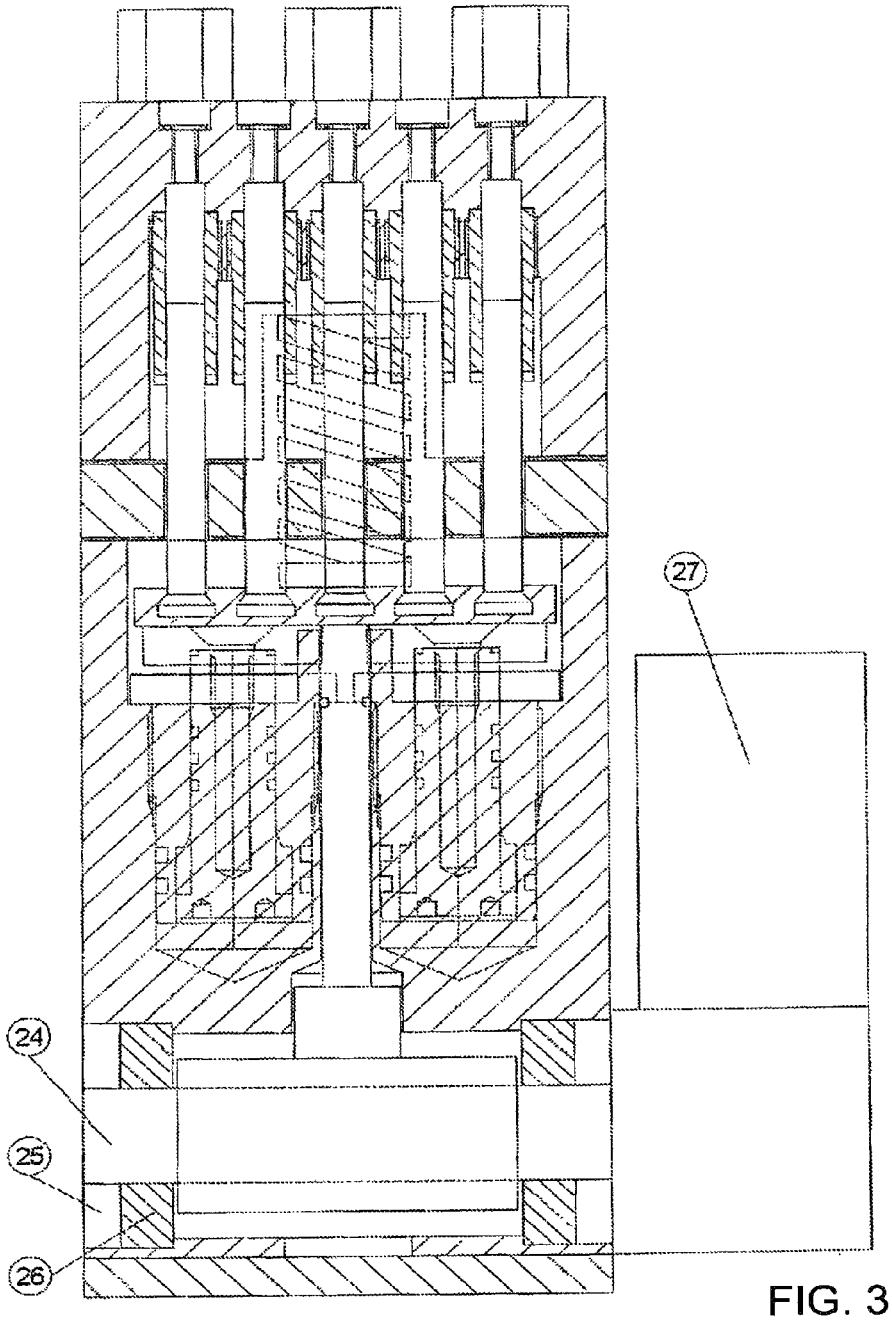
FIG. 3 PRIOR ART
FIG. 3 shows a sectional view of the lubricating apparatus shown in FIG. 2.

FIG. 3 shows a section through the lubricating apparatus according to prior art in FIG. 2 and with adjustment of stroke by a spindle and a DC motor.

Pos. 3 shows the eccentric shaft that enables stroke adjustment. Furthermore, it will be relatively easy to establish a stroke reading scale by mounting a scale at the side of the base block 2, thereby using the eccentric shaft position for reading the stroke length directly.

Pos. 25 shows a sealing ring ensuring that possible leak oil cannot run out and simultaneously ensuring that dirt cannot come in.

Pos. 26 shows a bearing which controls the eccentric shaft 24.

Pos. 27 shows a DC motor, possibly with worm drive, which, depending on control signals, changes the position 24 of the eccentric shaft. An encoder or other system for controlling the stroke is mounted on shaft. This encoder is not shown on the depicted Figure.

Figure 4:
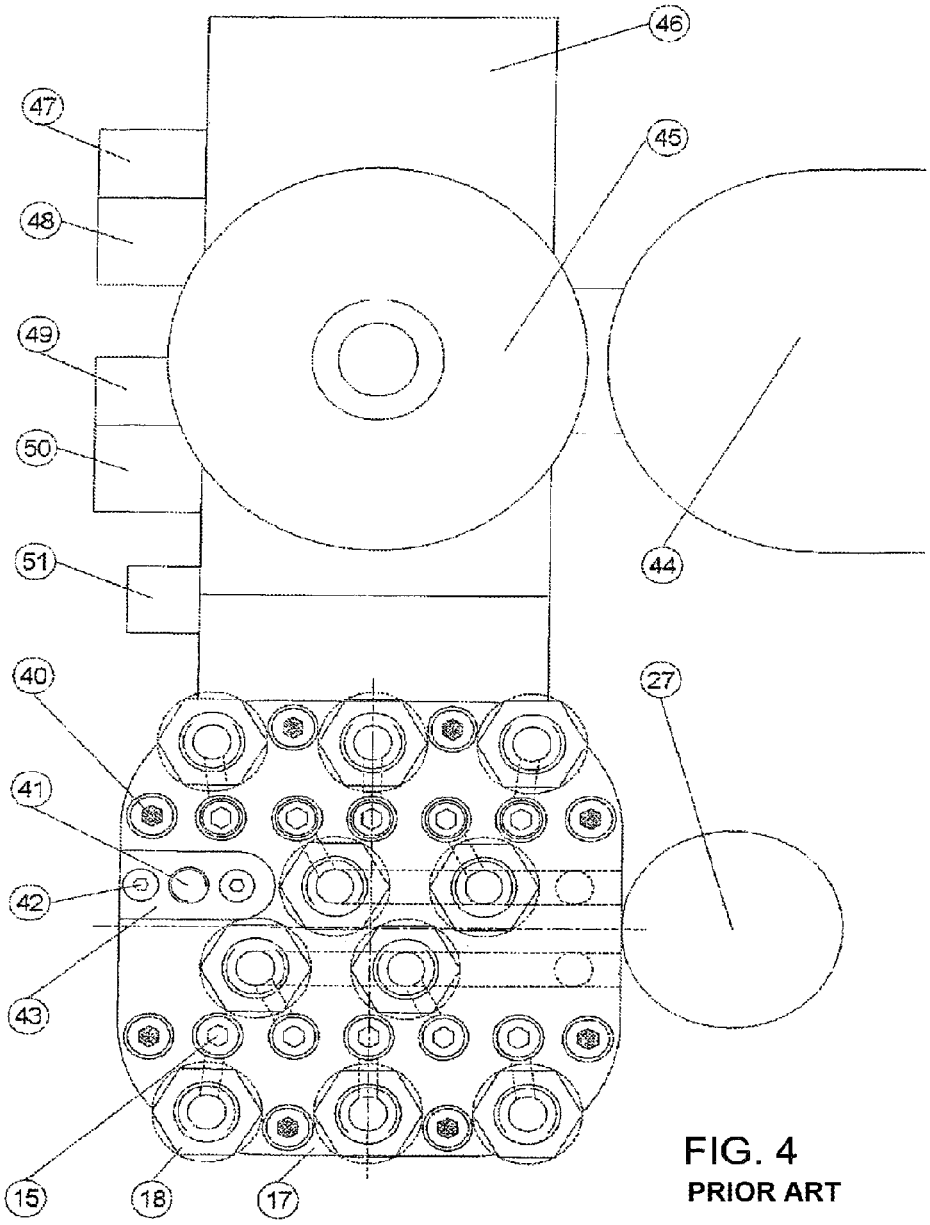
FIG. 4 PRIOR ART
FIG. 4 shows a plan view of the lubricating apparatus shown in FIGS. 2 and 3.

FIG. 4 shows a plan view of the lubricating apparatus shown in FIGS. 2 and 3 with supply block and DC motor. The Figure shows an embodiment where there are four hydraulic pistons divided into two groups.

Pos. 40 shows a mounting screw for fastening pump block 17 to the intermediate plate 8.

Pos. 41 shows a sensor detecting when the distributor plate 7 is in top position. The sensor is mounted on a fitting 43 so that it may be removed quickly if the pump block 17 is to the replaced.

Pos. 42 shows a screw for fastening sensor/fitting 41 and 43.

Pos. 43 shows a fitting for mounting the sensor 41.

Pos. 44-45 show accumulators at pressure and return sides, respectively, which are connected with the solenoid valves 47-50.

Pos. 46 shows a supply block through which the hydraulic oil is supplied/removed and through which the lubricating oil is conducted on to the base block 2.

Pos. 47 shows a solenoid valve for the return side of the hydraulic oil pressure. In group with solenoid valve 48.

Pos. 48 shows a solenoid valve for the pressure side of the hydraulic oil pressure. In group with solenoid valve 47. The solenoid valves 47 and 48 control one group of hydraulic pistons.

Pos. 49 shows a solenoid valve for the return side of the hydraulic oil pressure. In group with solenoid valve 50.

Pos. 50 shows a solenoid valve for the pressure side of the hydraulic oil pressure. In group with solenoid valve 49. The solenoid valves 49 and 50 control the other group of hydraulic pistons.

Pos. 51 shows a screw joint for supplying lubricating oil conducted through the base block 2 and through the intermediate plate 8 to the pump block 17.

Figure 5:
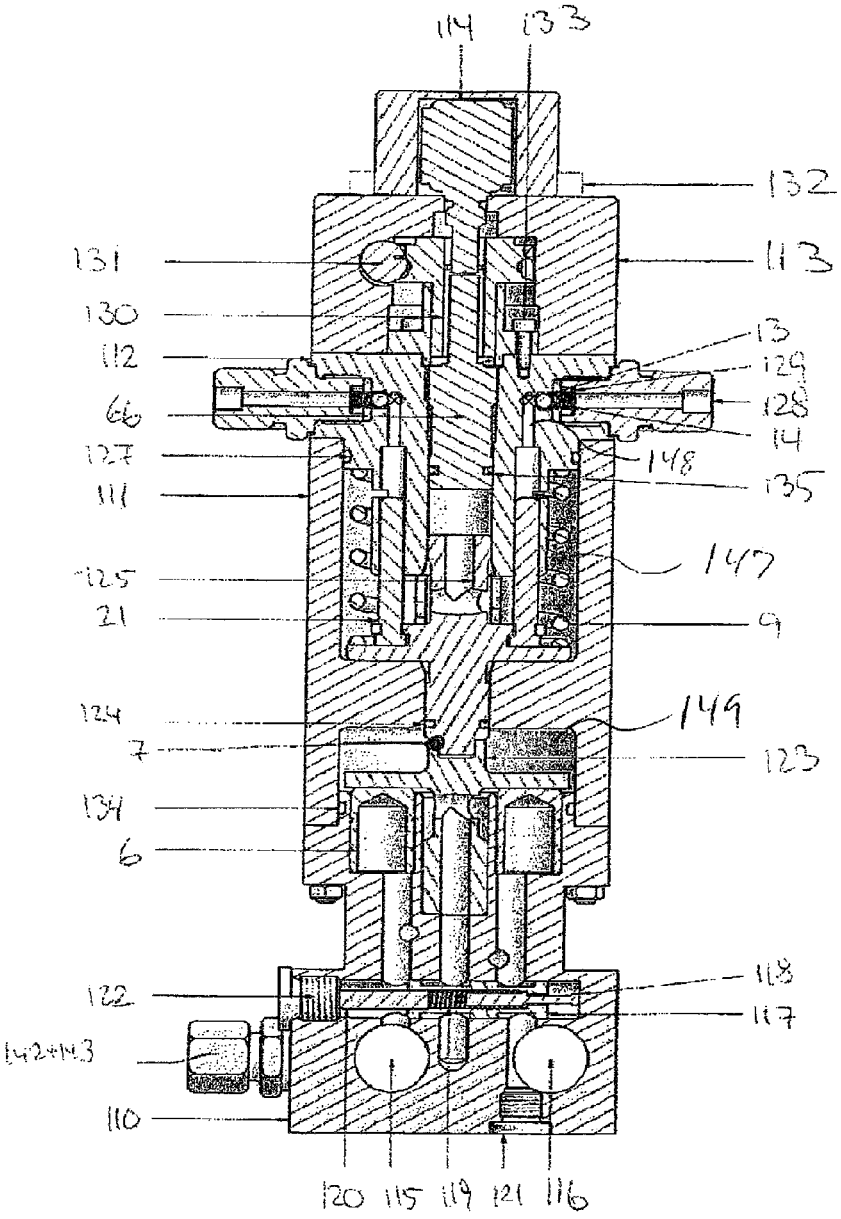
FIG. 5 PRIOR ART
FIG. 5 shows a sectional view through a further embodiment of a prior art lubricating apparatus.

FIG. 5 shows a further embodiment of a lubricating apparatus according to prior art.

The lubricating apparatus is made up of a bottom part 110 where solenoid valves 115 and 116 for activating the apparatus are mounted. At the side of the bottom part 110, screw joints are provided for system oil pressure supply 142 and system oil pressure return to tank 143.

The driving oil may be supplied through two solenoid valves, of which one is a primary solenoid valve 116 and the other is a secondary solenoid valve 115.

In the initial position, it is the primary solenoid valve 116 which is active. The driving oil is hereby conducted from the associated supply screw joint 142 to the primary solenoid valve 116 and via a switch valve 117 into the apparatus through a distribution channel 145 to the group of associated hydraulic pistons. This situation is shown in FIG. 15.

In case that the primary solenoid valve 116 fails it is possible automatically to connect the secondary solenoid valve 115. This valve is connected by activating the secondary solenoid valve 115. This situation is shown in FIG. 16.

The associated distribution channel 146 is hereby pressurised. This pressure entails that the switch valve 117 is displaced to the right, whereby the connection between the primary solenoid valve 116 and the associated distribution channel 145 is interrupted. The pressure is hereby removed from the hydraulic pistons connected to this solenoid valve 116.

By activating the secondary solenoid valve 115, the associated distribution channel 146 and the associated hydraulic pistons are pressurised. This causes that the distribution plate 7 is then driven by the oil conducted into the apparatus via the secondary solenoid valve 115.

The switch valve 117 may be equipped with a spring 119. In case of lack of supply pressure through the secondary solenoid valve, the spring will thus automatically put the switch valve 117 back to the above initial position.

The switch valve may be equipped with a restrictor so that this returning of the switch valve can be delayed. In this way is avoided/restricted that the switch valve 117 goes back and forth between the activations. On FIG. 5, the restriction is determined by a slot formed between a drain-pin 118 and the switch valve 117.

When each of the solenoid valves is connected to a separate group of hydraulic pistons, independence between the solenoid valves is ensured. When shifting between the primary solenoid valve 116 and the secondary solenoid valve 115, the switch valve 117 will ensure that the pressure is removed from the primary group of hydraulic pistons and thereby enable operation of the secondary solenoid valve 115, even in cases where the primary solenoid valve is blocked.

Pos. 121 shows a blanking screw.

Pos. 122 shows a combined blanking screw/end stop that partly act as end stop for the pawl 120 of the switch valve 117 and partly has a sealing function also via a (not shown) packing.

Above the hydraulic pistons 6 there is a distributor plate 7. The plate is shown here as a two-part design with an upper distributor plate member 125 and a lower distributor plate member 123. The dosing pistons 21 are mounted in/on the upper distributor plate member 125. In apparatuses where various oils are used for drive and lubrication, there is a piston packing 124 between the upper and lower distributor plate member. In principle, one may also suffice with using one kind of oil for drive oil as well as for lubricating oil.

Around the dosing pistons 21 there is a common return spring 9 which returns the pistons 21 after disconnecting the supply pressure on the hydraulic pistons 6. Around the return spring 9 there is a small lubricating oil reservoir 147 which is externally delimited by a base block 111. The lubricating oil is supplied through a separate screw joint with packings 138 and 139. The apparatus may optionally be equipped with a venting screw with packing 15 and 16.

Above the base block 111 the cylinder block 112 is located where the dosing pistons 21 are disposed for their reciprocating movement. Above the dosing pistons 21 there is a pump chamber 148. In this chamber there is an outlet with a non-return valve ball 13 which is biased by a spring 14. Furthermore, there is provided a screw joint 128 connected directly with the non-return valves/SIP valves in the cylinder wall.

For adjusting the stroke, in this embodiment there is shown an arrangement with a motor 132 coupled to a worm drive 131 which via a worm wheel 130 adjusts the stroke by changing the position on set pin/set screw 66.

In this embodiment, it is possible to adjust the stroke by changing the position of the stroke stop. This is different from the previous embodiment where a fixed point of origin was used and where the stroke was adjusted subsequently.

In order to control the actual stroke length, a sensor/pickup unit 114 is mounted in continuation of set pin/set screw 66 for detecting the stroke, e.g. in the form of an encoder or a potentiometer.

Pos. 113 shows a housing for the set pin/set screw arrangement.

Pos. 124 shows a piston packing sealing between the two spaces 149 and 147 with leak oil bypassing the hydraulic pistons 6 at the drive oil side at the bottom and the lubricating oil at the top, respectively.

Pos. 127 shows an O-ring sealing between the base block 111 and the cylinder block 112.

Pos. 133 shows a fastening screw for fastening a bearing case for the worm wheel 130.

Pos. 134 shows an O-ring sealing between the bottom plate 110 and the base block 111.

Figure 6:
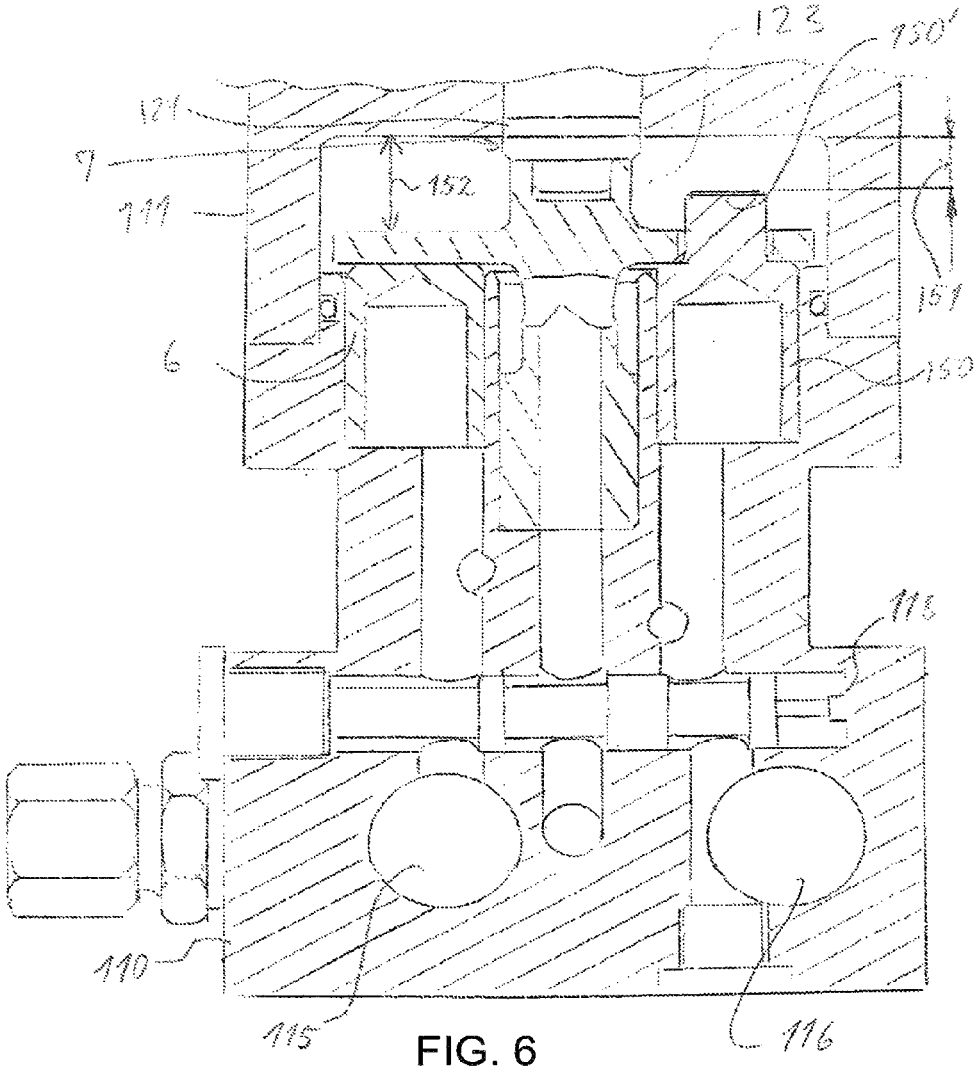
FIG. 6 PRIOR ART
FIG. 6 shows a partial section through a lubricating apparatus according to the invention corresponding to a modification of the lubricating apparatus shown in FIG. 5.

In FIG. 6 is shown a partial section through an embodiment of a lubricating apparatus according to the invention, where it is possible to establish an adjusting of quantity and cylinder lubricating oil by means of the hydraulic pistons 6 and 150.

In this embodiment according to the invention, it will be possible to dispense with the setting means in the form of the worm arrangement 131, 133 and the motor 132.

Here, different groups of hydraulic pistons are used for regulating amounts of lubricating oil. In the shown embodiment is illustrated two different types of hydraulic pistons 6 and 150, but there may be a plurality of groups with different pistons.

Each group of hydraulic pistons operates with each their stroke length. When one group of pistons 150 is activated, then there will be a stroke 151. When the other group of pistons 6 is activated, then there will be a stroke 152.

The amount of lubricating oil may thus be regulated by making an algorithm combining the use of the two strokes 150 and 151. Thus may be established an approximately stepless adjusting of the quantity of the lubricating oil within the range of the strokes 151 and 152.

The shown principle operates in that pistons in one group of pistons 150 are extended with a pin 150' extending through a hole in the distributor plate 7, thereby preventing the distributor plate 7 from going to its extreme position. When the pistons in the second piston group 6 are activated, the distributor plate 7 will move to the extreme position and be stopped by the base block 111.

Figure 7:
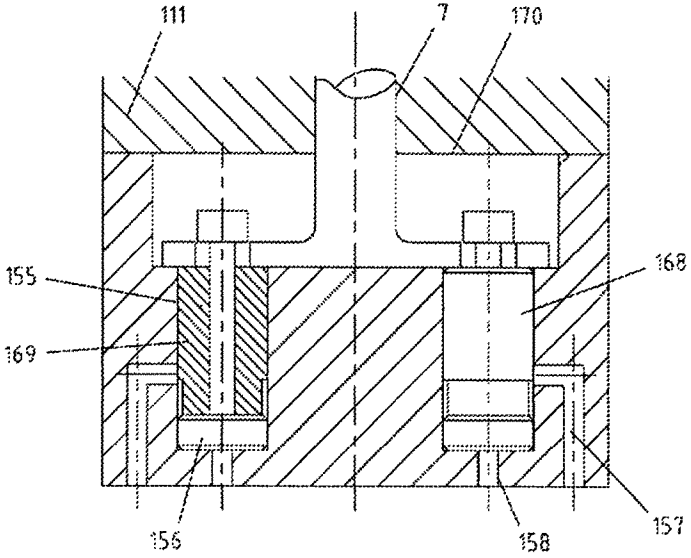
FIG. 7 shows a partial section through a further embodiment of a lubricating apparatus according to the invention.

FIG. 7 shows an embodiment, wherein a distributor plate 7 is actuated by two groups of hydraulic pistons 155 and 168, where each group has two hydraulic pistons that each may be actuated by its own solenoid valve. One piston 155 is shown partly in section while the other piston 168 is shown in side view. The two pistons 155 and 168 are identical. The dosing pistons actuated by the distributor plate 7 are not shown in FIG. 7.

In this embodiment, a piston 155, 168 may perform three different strokes. This is enabled by making the hydraulic pistons 155, 168 with several piston sections. The hydraulic piston/distributor plate is then provided three possible positions.

Figure 8:
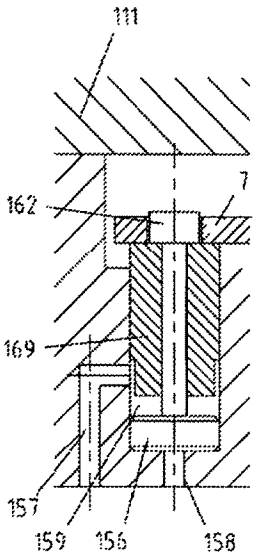

In FIG. 8 is shown how hydraulic oil is supplied through channel 157 by the supply pressure. The uppermost piston section 169 may hereby be displaced simultaneously with displacing the distributor plate 7 until a bolt 162 strikes the top side of the uppermost piston section 169.

Figure 9:
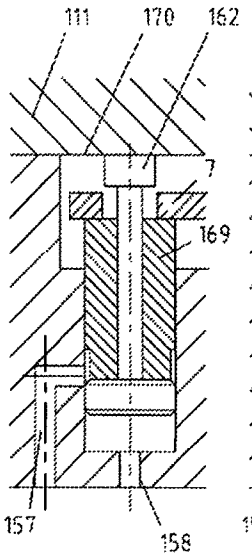

In FIG. 9 is shown how the hydraulic oil is supplied through channel 158 by the supply pressure. The lowermost piston section 156 may hereby be displaced. This occurs simultaneously with the uppermost piston section 169 being displaced until the bolt 162 strikes a face 170 in base block 111 which is part of the housing of the lubricating apparatus.

Figure 10:
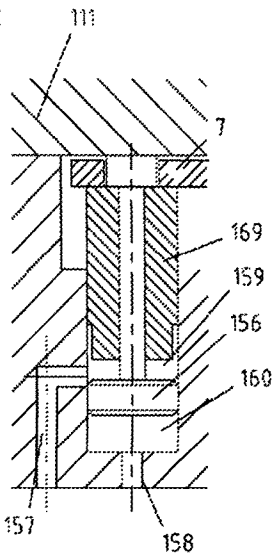
FIGS. 8-10 show partial sections through the lubricating apparatus shown in FIG. 7 for illustrating various quantity adjustments.

In FIG. 10 is shown how the hydraulic oil is supplied through both channels 157 and 158 by the supply pressure, and thereby to both piston sections 156 and 169. The distributor plate 7 may hereby be displaced right up to its shown extreme position.

The above shows how a group of hydraulic pistons, each consisting of one or more pistons, may perform different strokes. In the shown example, three possible positions of the distributor plate 7 are possible.

Figure 11:
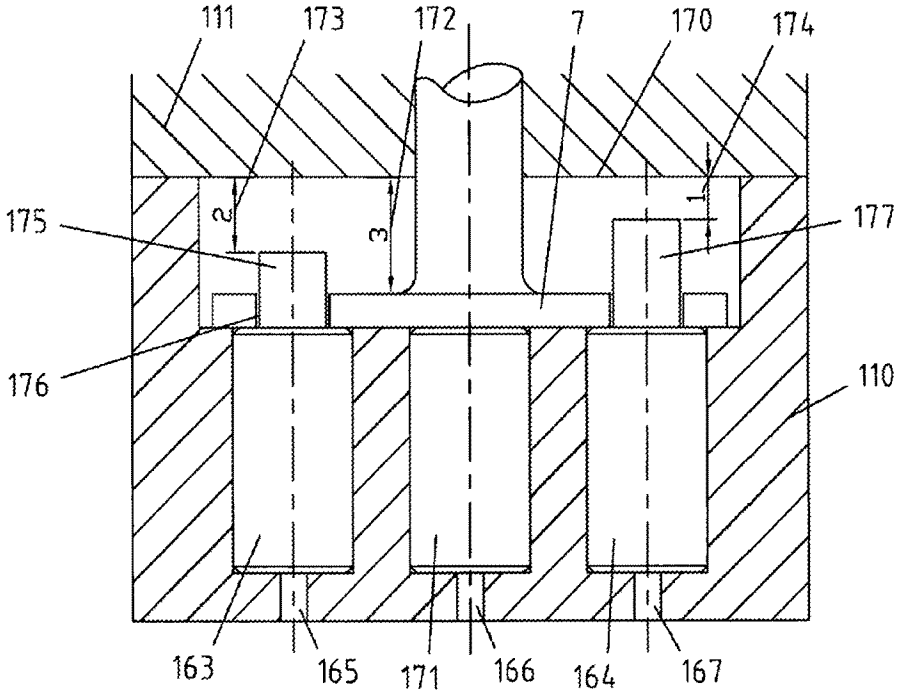
FIG. 11 shows a partial section through a further embodiment of a lubricating apparatus according to the invention.

FIG. 11 shows a distributor plate 7 that may be driven by three independent pistons 163, 164 and 171, each having a given stroke 173, 174 and 172, respectively.

By feeding hydraulic oil via channel 166, the hydraulic piston 171 lifts the distributor plate 7 until the distributor plate strikes the base block 111. Hereby a maximum stroke 172 is performed, thereby delivering a maximum quantity of cylinder lubricating oil by the dosing pistons which are actuated by the distributor plate 7.

By instead supplying hydraulic oil through channel 165, the hydraulic piston 163 lifts the distributor plate, but as this piston has an extension 175 extending through a hole 176 in the distributor plate 7, this piston 163 will not be able to move the distributor plate 7 as far as the piston 171. Thus a shorter stroke 172 is performed, whereby a smaller quantity of cylinder lubricating oil is delivered by the dosing pistons actuated by the distributor plate 7.

By instead supplying hydraulic oil through channel 167, the hydraulic piston 164 lifts the distributor plate 7. However, since this piston 164 has a longer extension 177 extending up through a hole 178 in the distributor plate 7, this piston 164 will then analogously move the distributor plate 7 even less before its extension strikes the base block 111. Thus an even shorter stroke 174 is performed, whereby an even smaller amount of cylinder lubricating oil is delivered by the dosing pistons which are actuated by the distributor plate 7.

We are speaking of a distributor plate 7, but in cases where there is only one piston in each group, this may also be called an actuator.

The distributor plate 7 is activated hydraulically in that a hydraulic system supplies a system pressure. The apparatus operates in that there are a plurality of groups of hydraulic pistons, where each group may be activated independently of the others. The hydraulic pistons 6 drive a distributor plate 7, whereby dosing pistons are displaced and perform a lubricating stroke.

Normally, the quantities of cylinder oil dosed in this type of systems are regulated either by regulating the stroke itself and by changing the lubrication frequency. The present invention is based on using groups of independent pistons where each group is designed such that they each provide the lubricating apparatus with a different stroke. By using a control algorithm for controlling which group to be activated, a stepless lubricating oil regulation can be made in practice.

Some users of systems prefer delivery of lubricating oil at each engine stroke, while others believe that there are no problems with skipping one or more engine strokes. If desired, the present invention provides the possibility of regulating the amount of lubricating oil from 0 mm to a given maximum stroke, and within this range the regulation of the amount of lubricating oil will be stepless.

The invention claimed is:

1. Lubricating apparatus in an engine for dosing engine cylinders with lubricating oil, the lubricating apparatus comprising:

a housing;

a source of cylinder lubricating oil;

one or more valves connected with the source for supplying cylinder lubricating oil;

a number of hydraulic cylinders that each have a hydraulic piston and which are pressurised by hydraulic oil;

a number of lubricating oil injection units corresponding to a multiple of the number of cylinders in the engine, and in which each lubricating oil injection unit is connected with each their dosing cylinder by a lubricating oil dosing piston;

each engine cylinder having a plurality of lubricating oil dosing pistons; and a distributor plate which at one side is in contact with the dosing pistons and which at its other side is in contact with the hydraulic pistons for displacing the distributor plate for actuating the dosing pistons, wherein the hydraulic pistons that displace the distributor plate are provided in groups of hydraulic pistons, and wherein each group of hydraulic pistons is adapted for independent displacement of the distributor plate for actuating the dosing pistons, and that each group of hydraulic pistons has an individual stroke, whereby controlling strokes of groups of hydraulic pistons controls differential actuating of the dosing pistons.

2. Lubricating apparatus according to claim 1, wherein each group of hydraulic pistons comprises one hydraulic piston.

3. Lubricating apparatus according to claim 2, wherein the hydraulic pistons are telescoping hydraulic pistons with several smaller hydraulic pistons disposed within each larger hydraulic piston.

4. Lubricating apparatus according to claim 1, wherein in each group of hydraulic pistons further comprises two or more hydraulic pistons.

5. Lubricating apparatus according to claim 1, wherein holes are formed in the distributor plate, and that at least some of the hydraulic pistons extend through at least some of the holes formed in the distributor plate.

6. Lubricating apparatus according to claim 1, wherein a surface is provided within the housing and above the distributor plate, and that this surface is used as contact surface for the hydraulic pistons.

7. Lubricating apparatus of claim 1, wherein the engine is a marine engine.

8. The apparatus of claim 1, wherein the hydraulic pistons control an angle of the distributor plate and a motor driven eccentric and rod drives the displacement plate.

9. A method for dosing cylinder lubricating oil in engines, the method comprising:

supplying hydraulic oil to a number of hydraulic cylinders with a number of hydraulic pistons wherein each hydraulic cylinder has one hydraulic piston and each hydraulic cylinder is pressurised by the hydraulic oil;

supplying and injecting cylinder lubricating oil via a number of injection units corresponding to a multiple of a number of engine cylinders in an engine, wherein each of the injection units further comprises a dosing piston in a dosing cylinder and each injection unit being connected by its dosing cylinder to the dosing piston, wherein the dosing piston is in contact with a distributor plate; and wherein the distributor plate is in contact at one side with the dosing pistons of the number of injection units and wherein an other side of the distributor plate is in contact with the hydraulic pistons for displacing the distributor plate with the hydraulic pistons for actuating the dosing pistons, wherein the hydraulic pistons are provided in groups, and each group independently displaces the distributor plate for actuating the dosing pistons, and that each group of hydraulic pistons have individual strokes.

10. Method according to claim 9, wherein only one hydraulic piston is used for each group.

11. The method of claim 9, wherein the engine is a marine engine.

12. The method of claim 9, wherein the hydraulic pistons control an angle of the distributor plate and a motor driven eccentric and rod drives the displacement plate.

* * * * *